United States Patent [19]

Zinn et al.

[11] Patent Number: 4,929,172

[45] Date of Patent: May 29, 1990

[54] STABLY OPERATING PULSE COMBUSTOR AND METHOD

[75] Inventors: Ben T. Zinn, Atlanta, Ga.; David Reiner, Haifa, Israel

[73] Assignee: Georgia Tech Research Corporation, Atlanta, Ga.

[21] Appl. No.: 343,084

[22] Filed: Apr. 25, 1989

[51] Int. Cl.[5] ..... F23C 11/04

[52] U.S. Cl. ..... 431/1; 60/39.76

[58] Field of Search ..... 431/1; 122/24; 60/39.76, 39.77, 39.8

[56] References Cited

U.S. PATENT DOCUMENTS 4,529,377 7/1985 Zinn et al. ..... 432/58

4,640,674 2/1987 Kitchen ..... 431/1

4,642,046 2/1987 Saito et al. ..... 431/354

4,699,588 10/1987 Zinn et al. ..... 432/58

4,708,635 11/1987 Vishwanath ..... 431/1

4,770,626 7/1987 Zinn et al. ..... 431/1

4,832,598 5/1989 Kitchen ..... 431/1

*Primary Examiner*—Randall L. Green

*Attorney, Agent, or Firm*—Hurt, Richardson, Garner, Todd & Cadenhead

[57] ABSTRACT

A pulse combustor apparatus adapted to burn either a liquid fuel or a pulverized solid fuel within a preselected volume of the combustion chamber. The combustion process is substantially restricted to an optimum combustion zone in order to attain effective pulse combustion operation.

15 Claims, 1 Drawing Sheet

STABLY OPERATING PULSE COMBUSTOR AND METHOD

This invention was made with Government support under contract DE-AS04-85AL31881, awarded by the U.S. Department of Energy. The Government has certain rights in this invention.

BACKGROUND OF THE INVENTION

1. Field of the Invention

This invention relates to a stably operating pulse combustor and a method for stabilizing the combustion process at a desired location in a Rijke-type pulse combustor. This invention also relates to a pulse combustor adapted to burn either a liquid fuel or a pulverized, solid fuel within a preselected location of the combustion chamber, thereby ensuring that the acoustic pulsations in the combustor are utilized to a maximum beneficial extent to, inter alia, optimize the performance of the combustor.

2. Description of the Prior Art

Although pulse combustors have been generally known for many years, I disclosed in my U.S. Pat. No. 4,529,377 for the first time a pulse combustion apparatus capable of stably burning unpulverized solid fuels. This pulse combustor utilizes the excitation of sound waves to obtain beneficial results. The benefits achieved by this device include increased efficiency of the combustion process, improved heat transfer, and the reduction of pollutants and slagging. As shown in the '377 patent, in order to excite pulsations in a Rijke-type pulse combustor, most of the combustion process energy must be released at a distance of L/4 from the combustor entrance plane, where L is the combustor length. More generally, most of the combustion process energy must be released at a distance of $\lambda/8$ from the acoustic pressure minimum, where $\lambda$ is the excited acoustic wavelength and where the acoustic velocity oscillations lead the acoustic pressure oscillations by 90 degrees. In this combustor, it is also required that the flow of gases be directed towards the location of the acoustic pressure maximum immediately downstream of the combustion region.

In Rijke-type combustors it is difficult, however, to attain nearly complete combustion of the fuel over a relatively short distance around the above-specified location on the excited acoustic wavelength. For example, when burning liquid and pulverized solid fuels, the combustion process is often distributed over a significant fraction of the combustor length. When this occurs, only a fraction of the combustion energy is released at the optimum location where it can excite acoustic pulsations, while the remaining fraction of the combustion energy is released beyond the location of maximum acoustic pressure amplitude where it tends to dampen the pulsations. Satisfactory combustor operation cannot, therefore, be attained under such operating conditions. The known literature does not disclose the existence of either a method or apparatus directed to stabilizing the combustion process in a specific volume of a pulse combustor.

Prior pulse combustors and combustion systems are generally described in U.S. Pat. No. 4,529,377 to Zinn, et al.; U.S. Pat. No. 4,699,588 to Zinn, et al.; U.S. Pat. No. 4,770,626 to Zinn, et al.; U.S. Pat. No. 4,642,046 to Saito, et al.: U.S. Pat. No. 4,708,635 to Vishwanath: and U.S. Pat. No. 4,640,674 to Kitchen. These prior art references, however, do not address the problem of decreased efficiency of pulse combustors burning liquid or pulverized solid fuels caused by the combustion process energy being released outside of an optimum combustor location. None of these references provide any method or apparatus for stabilizing the combustion process of liquid or pulverized solid fuels at an optimum combustor location, to attain effective pulse combustion operation.

SUMMARY OF THE INVENTION

Briefly described, the present invention includes a Rijke-type pulse combustor apparatus having combustion characteristics directly related to the excitation of the fundamental, longitudinal, acoustic mode of the combustor, whereby combustion and heat transfer and other related processes occur under pulsating conditions. This pulse combustor is specifically adapted to stabilize the combustion process, or in other words, to confine the combustion process to substantially a preselected volume within the combustion chamber. The combustor includes an elongate combustor body or combustor tube being open at either end, or including a decoupling chamber at either end, to maintain "open-ended" acoustic boundary conditions at the combustor inlet and exit planes. The combustor is preferably adapted to burn either liquid or pulverized solid fuels, although, as hereinafter discussed, it can also be modified to burn gaseous fuels. The combustor body defines an interior combustion chamber having a combustion zone, the center of which is located at a distance one quarter of the length of the combustor tube from the intake or inlet end of the tube.

A fuel-air injection system assembly feeds a fuel-air mixture into the combustion zone, where combustion of the fuel occurs and heat is released. The injection system assembly is arranged in relation to the combustor body so that the fuel-air mixture enters the combustor at the combustion zone location tangentially, in a swirling manner. Additionally, secondary air is introduced axially into the combustion zone to assist in stabilizing the combustion process at the desired location. An ignitor, which is activated prior to the injection of the fuel-air mixture into the combustion chamber, ignites the mixture, initiating the combustion process. In this manner, the combustion process is stabilized or anchored in the combustion zone near the point of tangential injection of the fuel-air mixture, to ensure that most of the fuel energy is released within the delineated, optimum combustion zone.

An alternate embodiment permits the efficient, stabilized combustion of a heavy fuel oil. In this embodiment, fuel oil and a gas, such as methane or air, are mixed in a mixer. The air or methane gas-fuel oil mixture is delivered through a feed line into a pulse combustor substantially identical in structure to the combustor previously described. As the fuel line enters the pulse combustor, the line may loop or coil within the combustion chamber. In this fuel line or evaporation coil, heat transfer from the surrounding flame and/or hot gases evaporates some of the liquid fuel. The resulting two-phase mixture of liquid fuel and fuel vapor is injected radially into the combustor, at the desired location of the combustion zone. A looped fuel line in this embodiment, however, is not required to attain stable combustion. The fuel line could enter the chamber without looping, and terminate in a radial injector. As in the prior embodiment, secondary air is directed axially into the combustion chamber of the combustor body and mixed with the fuel mixture for combustion. This embodiment also accomplishes a stabilization of the combustion process at the desired L/4 location, thus resulting in optimum conditions for the excitation of the acoustic pulsations.

Accordingly, it is an object to the present invention to provide a stably operating pulse combustor which possesses high combustion and thermal efficiencies, is inexpensive to manufacture, and durable in structure.

Another object to the present invention is to provide a pulse combustor in which the combustion process is stabilized substantially within a combustion zone located at approximately one-half of the distance between the acoustic pressure node and antinode, where the acoustic pressure oscillation lags the acoustic velocity oscillation by approximately one quarter wavelength of the oscillation.

Another object to the present invention is to provide a stably operating pulse combustor in which the combustion zone is located one quarter of the length of the combustor tube, away from the inlet of the combustor tube.

Another object to the present invention is to provide a stably operating pulse combustor in which air and a liquid fuel are premixed and injected tangentially in a swirling state into the combustion zone of the pulse combustor.

Another object to the present invention is to provide a stably operating pulse combustor in which most of the combustion process energy is released in a specified combustion zone, so that maximum-amplitude acoustic pulsations are excited.

Another object to the present invention is to provide a stably operating pulse combustor which can be used for the combustion of high and low quality liquid fuels, such as kerosene, and fuel oils nos. 5 and 6.

Another object to the present invention is to provide a stably operating pulse combustor which can be used for the combustion of pulverized solid fuels, such as wood chips, bituminous and subbituminous coals.

Another object to the present invention is to provide a stably operating pulse combustor which can be utilized for heating water, heating industrial liquids, for steam raising, space heating, for the heating of gases in dryers which use indirect heating, and for supplying the gases for dryers.

Another object to the present invention is to provide a stably operating pulse combustor which can be used as a coal gasifier.

Another object to the present invention is to provide a stably operating Rijke-type pulse combustor capable of burning liquid fuels and/or pulverized solid fuels.

Another object to the present invention is to provide a method for stabilizing a combustion process within a Rikje-type pulse combustor.

Other objects, features and advantages of the present invention will be apparent from the following description when taken in conjunction with the accompanying drawings wherein like characters of reference designate corresponding parts throughout the several views.

DESCRIPTION OF THE PREFERRED EMBODIMENTS

Figure 1:
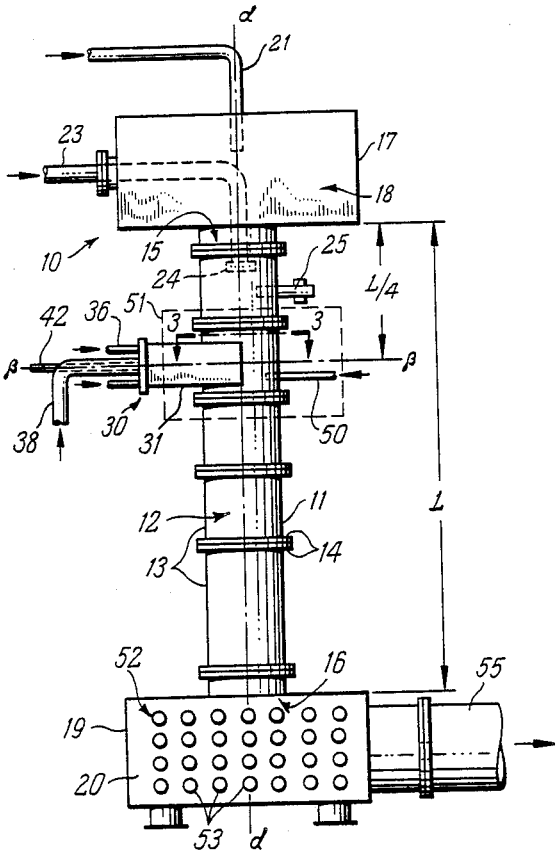
FIG. 1 is a stably operating pulse combustor of the present invention.

Referring now to the drawings, wherein like reference numerals designate identical corresponding parts throughout the several views, and more particularly to FIG. 1, the pulse combustor 10 includes an elongate, annular combustor tube or body 11 having longitudinal axis $\alpha$ and defining therein an interior, elongate, open combustion chamber 12. While the combustor 10, as shown in FIG. 1, is oriented vertically, the combustor of the present invention is operable at any orientation other than the vertical. The combustor body 11 is comprised of tubular sections 13 having annular flanges 14 at either end. Several tubular sections 13 are arranged end to end by abutting respective flanges 14. The respective flanges 14 are then joined for assembly of tube 11 by any suitable means commonly known in the art. Elongate combustor body 11 defines an inlet or intake 15 at one end, and an outlet or exhaust 16 at the opposite end. Positioned at the intake 15 of combustor body 11 is a hollow intake manifold 17 which defines intake decoupling or expansion chamber 18 therein. Intake 15 freely communicates with intake expansion chamber 18. Similarly positioned at the exhaust 16 is hollow exhaust manifold 19 which defines exhaust decoupling or expansion chamber 20.

A hollow, tubular secondary air inlet or plenum 21 is attached at end 22 to a blower (not shown), and extends downwardly, terminating in chamber 18 of intake decoupling manifold 17. As described hereinafter, secondary air inlet 21 provides a means through which secondary air is injected axially into the decoupling chamber 18 and then into the combustion chamber 12. An elongate, tubular fuel line 23 also extends through upper decoupling manifold 17 and into combustion chamber 12 below intake 15. Preheat fuel line 23 terminates in a radial-type fuel injector 24. Radial-type fuel injectors are well known in the art, and so not further described herein. Fuel passing through line 23 and out of radial injector 24 is ignited in order to preheat the pulse combustor 10. Positioned in wall 11 of combustor 10 is ignitor 25 which extends into chamber 12 to ignite a fuel-air mixture and to begin the combustion process. The elements herebefore described are generally well known and their cooperation and function is understood by those skilled in the art.

Positioned in normal relationship to combustor body 11 is the fuel-air injection system assembly 30. The injection system assembly 30 depicted in FIG. 1 is shown positioned tangentially with respect to elongate combustor body 11, having a central axis $\beta$. Preferably, central axis $\beta$ is located one quarter of the length L of combustor body 11 from intake 15.

Figure 2:
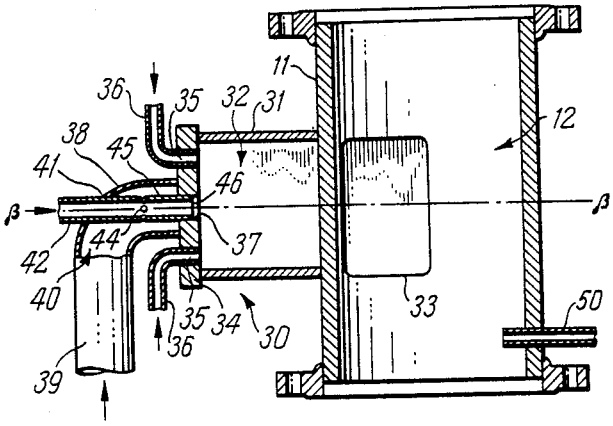
FIG. 2 is a cross-sectional view of a section of the combustor of FIG. 1, including the fuel-air injection system assembly.

Injection system assembly 30 includes an elongate, hollow inlet plenum 31 which defines therein mixing chamber 32 and which is attached at one end to combustor body 11. Rectangular-shaped mixture inlet port 33 is defined by the combustor body 11, and permits free communication of mixing chamber 32 with combustion chamber 12. Rectangular port 33 additionally curves along annular side wall 11, as shown in FIG. 2. Endcap 34 of injection system assembly 30 fully covers the outer end of inlet plenum 31 and defines therethrough spaced, swirling air inlet ports 35. Swirling air inlet feeder lines 36 are attached at one end to a blower (not shown), and communicate at their other end in sealed relationship around the peripheries of inlet ports 35, to deliver swirling air into inlet plenum 31. Endcap 34 also defines centrally disposed mixture inlet port 37 therein.

Attached to endcap 34 and communicating at one end in sealed relationship around and spaced from the periphery of mixture inlet port 37, is tubular fuel line 38. Fuel line 38 includes annular side wall 39, and defines therein fuel inlet chamber 40. As shown in FIG. 2, side wall 39 defines aperture 41 through which passes tubular, elongate, primary air inlet line 42. Inlet line 42 passes through chamber 40, and attaches to endcap 34 in sealed relationship around the periphery of port 37. Side wall 39 is attached to air line 42 in sealed relationship to prevent any passage of fuel out of fuel line 38 through aperture 41.

Primary air line 42 is preferably positioned centrally disposed along axis $\beta$ with respect to inlet plenum 31. Air line 42 is connected at end 43 to a blower (now shown) and defines apertures 44 at inner portion 45, which pass through 42. Air line 42 could be venturi-shaped at inner portion 45 to optimize the entraiment of gas, although the venturi shape is not critical to the operability of the injection system assembly 30. Primary air line 42 terminates defining outlet port 46 which communicates with mixing chamber 32.

Positioned tangentially with respect to combustor body 11 opposite and below rectangular port 33 is tubular high velocity air inlet line 50, which communicates with chamber 12 and can optionally be used to deliver tertiary air into combustion chamber 12 to assist in the combustion process. Thus, the combustor 10 defines a combustion zone outlined generally and denoted as zone 51, the central, horizontal axis of which is indicated by line $\beta$. The combustion zone 51 includes a section of combustor tube 11 downstream from axis $\beta$ to include that volume of the combustion chamber 12 where combustion continues to take place. The combustion zone 51 can also extend a short distance upstream of the axis $\beta$ due to reverse flow caused by pulsations and flow recirculation. Inside the lower decoupling chamber 19 is heat exchanger 52. As is well know in the art, heat exchanger 52 includes pipes 53 through which water or other fluid is pumped.

Figure 3:
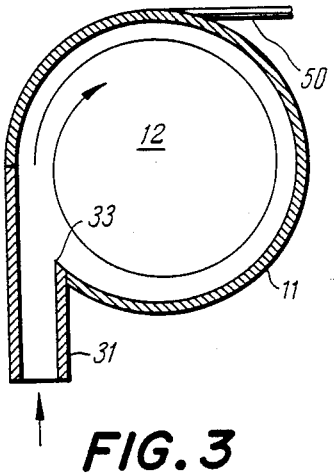
FIG. 3 is a cross-section taken generally along lines 3—3 of FIG. 1.

In operation, kerosene or other fuel is pumped through fuel line 23 and is injected into combustion chamber 12 through radial injector 24. The kerosene is ignited by ignitor 25 to preheat combustion chamber 12. Primary air is pumped into mixing chamber 32 through primary air inlet line 42. Simultaneously, fuel line 38 is filled with liquid fuel. Thus, fuel cannot pass from chamber 40 directly into mixing chamber 32, but is forced through fuel ports 44 and is entrained into the air passing through primary air line 42 into chamber 32. A fuel-air mixture, therefore, passes from port 46 into mixing chamber 32. Simultaneously, swirling air is pumped through air lines 36 and into mixing chamber 32 to mix with the fuel-air mixture exiting port 46. This fuel-air mixture is then delivered through rectangular port 33 into combustion chamber 12. As shown in FIG. 3, the fuel-air mixture is delivered tangentially into combustion chamber 12 where the fuel-air mixture swirls within combustion zone 51. Either the kerosene flame or ignitor 25 are used to ignite the fuel-air mixture to begin the pulsating combustion process. Additionally, secondary air is delivered through secondary air inlet 21 axially into combustion chamber 12 to assist in the combustion process, and to help direct the combustion products towards exhaust 16. For most fuels, this stabilized pulse combustor 10 operates optimumly when approximately 70% of the total air entering chamber 12 enters through port 33, and approximately 30% enters axially through inlet 21.

The generated, hot combustion products move downwardly as shown in FIG. 1, through exhaust decoupling chamber 20 and out through exhaust pipe 55. As the hot exhaust gases pass over heat exchanger 52, a fluid such as water pumped through heat exchanger 52 is heated, and the heated fluid, water, vapor or steam is then utilized for various practical applications. Alternatively, the hot combustion gases can be used in dryers which use direct or indirect heating, or to heat industrial liquids, or for space heating. The combustor 10 itself can also be used as a heating element in other applications. Further, gaseous instead of liquid fuel can be delivered through fuel line 38 and through fuel ports 44 to mix with the primary air in mixing chamber 32 for delivery to combustion chamber 12.

This pulse combustor 10 can also be utilized to burn pulverized, solid fuels instead of liquid or gaseous fuels. When pulverized, solid fuels are burned, aperture 41 and primary air inlet 42 are eliminated. The pulverized, solid fuel, such as bituminous coal or woodchips, are mixed with air in a mixing device (not shown) which is well known in the art and not further described herein. The pulverized, solid fuel-air mixture is delivered through fuel line 38 and into mixing chamber 32 where it is mixed with the swirling air delivered through air lines 36 and injected into combustion chamber 12 in a tangential manner, as discussed above. The solid fuel-air mixture is ignited and the combustion process commences under pulsating conditions. This arrangement allows the combustion of pulverized, solid fuels to be stabilized in the pulse combustor 10, identically as discussed above. This pulse combustor 10 can also be operated under fuel rich conditions to function as a solid fuel gasifier. Air and pulverized coal mixture are injected tangentially into chamber 12 through injection assembly 30, utilizing less air than is required for complete combustion. The generated mixture of gaseous fuel and combustion products can then be burned with a secondary air stream downstream of the exhaust 16.

Figure 4:
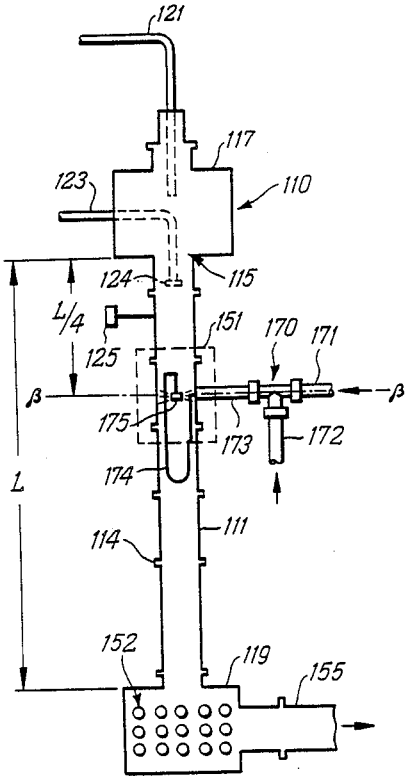
FIG. 4 is a schematic side view, partly in cross-section, of another embodiment of the present invention.

A second embodiment of the present invention permits heavy fuel-oil, such as fuel oil no. 5, to be stably burned in a pulse combustor, while eliminating many of the disadvantages of burning such a fuel. As shown in FIG. 4, a pulse combustor 110 is identical to the pulse combustor 10 of the first embodiment, with the exception of the apparatus for delivery of the fuel into the combustion chamber. Fuel oil and a gas, such as methane or air, are mixed in a fuel-air mixing apparatus 170. Such a mixing apparatus 170 is well known in the art, and includes gas intake line 171 and a liquid fuel intake line 172, for introduction of gas and liquid fuel, respectfully, into mixing apparatus 170. This gas-liquid fuel mixture is delivered through mixture outlet line 173 and into a tubular feed line 174 in the combustion chamber 112. The feed line 174 can be looped, as is shown in FIG. 4, or can be straight. If a looped feed line is used, the looped line acts as a preevaporator. Feed line or evaporation coil 174 terminates with radial injector 175.

In operation, the combustion chamber 112 is preheated by igniting a fuel such as kerosene, delivered through preheat fuel line 123 and out of preheat injector 124. The gas-fuel oil mixture is delivered from assembly 170 into feed line 174, where heat transfer from the surrounding flames and hot gases evaporates some of the liquid fuel. The resulting, two-phase mixture of liquid fuel and fuel vapor is injected into the combustor chamber 112, radially through radial injector 175. Radial injector 175 is located along axis $\beta$ which is at a distance L/4 from the combustor 110 entrance plane or intake 115 The evaporation of some of the fuel inside feed line 174 increases the pressure inside the feed line 174, which, in turn, results in better atomization of the injected liquid fuel stream. Thus, a finer spray of liquid fuel is injected through injector 175 into combustion chamber 112. Both the fuel preevaporation and its atomization into smaller drops result in a better and faster combustion process. The acceleration of the combustion process assures that most of the combustion process occurs over a short length of the combustor 110 near the desired combustion zone 151. As a result, stable combustion is achieved substantially in the preferred combustion zone 151.

Further, when a mixture of fuel and gas and a looped fuel line or evaporation coil 174 is used, another beneficial result is realized. The acoustic pressure oscillations in combustion chamber 112 propagate into feel line 174, resulting in a periodic or pulsating flow of the two-phase fuel-gas mixture in line 174, and out of injector 175. If the resulting oscillations of the heat release rate are in phase with the combustion pressure oscillations, driving of the pulsations is achieved. The premixing of the heavy fuel oil and methane gas also sets up a two-phase flow inside evaporation coil 174 that eliminates the problem of clogging caused by heavy hydrocarbonate deposits on the walls of the coil 174. With the exception of the method and apparatus for accomplishing stabilization of the combustion process within combustion chambers 12 and 112, respectively, the pulse combustor 10 and 110 perform substantially identically to and achieve the benefits as the combustors described in my U.S. Pat. No. 4,529,377.

It will be further obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. Method for stabilizing a pulse combustion process within a preselected volume of a pulse combustor, said pulse combustor having an elongated combustor body, an intake and an exhaust, and defining an interior combustion chamber, comprising the steps of:

(a) introducing secondary air axially into said combustion chamber;

(b) creating a fuel-air mixture by mixing fuel and primary air;

(c) introducing said fuel-air mixture tangentially into said preselected volume within said combustion chamber of said combustor body; and (d) creating a combustion process by igniting said fuel-air mixture in said preselected volume within said combustion chamber, whereby said pulse combustion process occurs within said preselected volume and combustion products are thereby created.

2. Method for stabilizing the pulse combustion process defined in claim 1, whereby said fuel-air mixture is created by dividing said primary air into an atomizing air stream and a swirling air stream, entraining fuel in said atomizing air stream and mixing said swirling air stream with said atomizing air stream and said entrained fuel.

3. The method as defined in claim 1, whereby a portion of said preselected volume is located at a distance of one-fourth of the length of said combustor body away from said intake of said pulse combustor.

4. The method as defined in claim 1, and introducing tertiary swirling air into said preselected volume.

5. The method as defined in claim 1, and preheating said preselected volume and combustion body prior to step (a).

6. The method as defined in claim 1, and (e) exhausting said products of said pulse combustion process away from said preselected volume.

7. The method as defined in claim 6, and repeating steps (a) through (e), whereby continuous pulse combustion of said fuel-air mixture and exhaustion of said products of combustion is accomplished.

8. The method as defined in claim 1, whereby said primary air constitutes approximately 70% of the total air used in said combustion process and said secondary air constitutes approximately 30% of the total air used in said combustion process.

9. A stably operating pulse combustor comprising:

(a) an elongated combustor body having a longitudinal axis, said combustor body defining a combustion chamber and having an intake and an exhaust;

(b) injection system assembly means communicating with said combustor body for introducing a fuel-air mixture tangentially into said combustion chamber;

(c) secondary air inlet means communicating with said combustor body for introducing secondary air axially into said combustion chamber; and (d) ignition means for igniting said fuel-air mixture, whereby said pulse combustion process is initiated and combustion products are created.

10. The apparatus defined in claim 9, wherein said injection system assembly means comprises an inlet plenum defining a mixing chamber and attached at one end to said combustor body, said plenum defining along one side a swirling air inlet port and a fuel-air mixture inlet port.

11. The apparatus defined in claim 10, and fuel entraining means communicating with said fuel-air mixture inlet port for entraining fuel into primary air and delivering said air and fuel mixture into said inlet plenum.

12. The apparatus defined in claim 9, and exhaust means communicating with said exhaust for exhausting said products of said combustion process from said combustor body.

13. The apparatus defined in claim 9, and an intake decoupling chamber communicating with said intake.

14. The apparatus defined in claim 9, and an exhaust decoupling chamber communicating with said exhaust.

15. The apparatus defined in claim 9, and a tertiary air inlet plenum communicating with said combustion chamber through said combustion body.

* * * * *